US011039703B2

(12) United States Patent
Ehizuelen

(10) Patent No.: US 11,039,703 B2
(45) Date of Patent: Jun. 22, 2021

(54) STRAW CAP

(71) Applicant: Esther Ehizuelen, Raleigh, NC (US)

(72) Inventor: Esther Ehizuelen, Raleigh, NC (US)

( * ) Notice: Subject to any disclaimer, the term of this patent is extended or adjusted under 35 U.S.C. 154(b) by 0 days.

(21) Appl. No.: 16/549,956

(22) Filed: Aug. 23, 2019

(65) Prior Publication Data

US 2020/0060456 A1 Feb. 27, 2020

Related U.S. Application Data

(60) Provisional application No. 62/722,132, filed on Aug. 23, 2018, provisional application No. 62/834,345, filed on Apr. 15, 2019.

(51) Int. Cl.
*A47G 21/18* (2006.01)
*B65D 77/28* (2006.01)

(52) U.S. Cl.
CPC ..... *A47G 21/182* (2013.01); *B65D 77/28* (2013.01)

(58) Field of Classification Search
CPC ..... A47G 21/182; A47G 21/18; B65D 65/02
USPC ..... 229/87.01, 87.05, 103.1; 220/705; D7/300.2, 391; 239/33; 53/461; 426/85
See application file for complete search history.

(56) References Cited

U.S. PATENT DOCUMENTS

D655,560 S * 3/2012 Stone ..... D19/155
10,011,413 B1 * 7/2018 Ryan ..... B65D 75/5827
2008/0197141 A1 * 8/2008 Felfoldi ..... A47G 21/183 220/705
2008/0256804 A1 * 10/2008 DeVries ..... A47G 21/184 30/90.8
2009/0256000 A1 * 10/2009 Wallace ..... A47G 21/18 239/33
2012/0261292 A1 * 10/2012 Lieb ..... B65D 75/38 206/457
2016/0159540 A1 * 6/2016 Jordan ..... B65D 75/5827 229/87.05

FOREIGN PATENT DOCUMENTS

WO WO-2015155592 A1 * 10/2015 ..... A47G 21/182

* cited by examiner

*Primary Examiner* — Christopher R Demeree

(57) ABSTRACT

According to an embodiment of the disclosure, a straw cap comprises a body that is configured to lie flat in a non-assembled state and has an interior volume that covers a straw in an assembled state. According to certain configurations the body has a triangular shape in the non-assembled state and at least a portion of a cone in an assembled state. Additionally, according to certain configurations, the body has a slit to selectively allow passage of a straw.

19 Claims, 4 Drawing Sheets

STRAW CAP

RELATED APPLICATIONS

This application is related to U.S. Provisional Application Nos. 62/834,345 (filed on Apr. 15, 2019) and 62/722,132 (filed on Aug. 23, 2019), both of which are incorporated by reference herein for all purposes. The present application hereby claims priority under 35 U.S.C. § 119(e) to U.S. Provisional Application Nos. 62/834,345 and 62/722,132.

TECHNICAL FIELD

This disclosure is generally directed to mechanisms that enable good hygiene. More specifically, this disclosure is directed to a triangular shaped, chic, fun and innovative both non-locking and locking straw (and drink) cap.

BACKGROUND

Society is rightfully fearful of germs, dust and other airborne particles. Often one will see another protecting his or her drink with a napkin attempting to prevent such germs, dust and other airborne particles, from penetrating into their drink. While well intended, such napkin designs are often ineffective and unattractive.

Exacerbating the rightful fear of germs, dust and other airborne particles, are Drink Mix-Ups. At a table with multiple clear liquid drinks in the same or similar cups with or without straws, people understandably mistake another drink as his or hers.

Some beverages attract unwanted insects and bugs like bees, flies, gnats, ants, and roaches, etc. They crawl, hover over or swarm around beverages and individuals near their drinks.

Unfortunately, sinister people intentionally tamper with other people's beverages by dropping foreign substances and harmful pills in them without much of a deterrent.

It is estimated that over 500 Million straws are used daily in the United States and that although legislation was recently passed in some states to ban or to reduce the use of plastic straws, materials others than plastic straws i.e. paper, wood, metal and other types of straw materials are on the rise.

It is also too cumbersome and inconvenient to carry around something to cover a drink and straw.

People like to have conversational pieces, and to have fun and to look at something nice, warm and nostalgic while drinking beverages, either at home, work, restaurants, parties or other gatherings and outings.

BRIEF DESCRIPTION OF THE DRAWINGS

For a more complete understanding of this disclosure and its features, reference is now made to the following description, taken in conjunction with the accompanying drawing, in which.

SUMMARY OF THE DISCLOSURE

Figure 1:
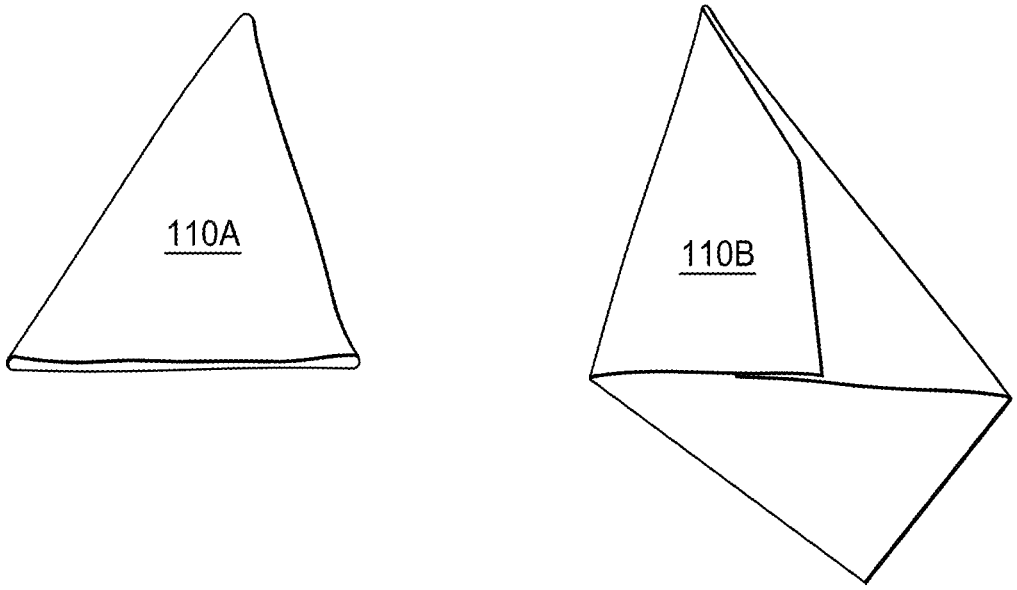
FIG. 1 shows configurations of straw caps in anon-assembled state, according to embodiments of the disclosure.

According to an embodiment of the disclosure, a straw cap comprises a body that is configured to lie flat in a non-assembled state and has an interior volume that covers a straw in an assembled state. According to certain configurations the body has a triangular shape in the non-assembled state and at least a portion of a cone in an assembled state. Additionally, according to certain configurations, the body has a slit to selectively allow passage of a straw.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The phrase "at least one of," when used with a list of items, means that different combinations of one or more of the listed items may be used, and only one item in the list may be needed. For example, "at least one of: A, B, and C" includes any of the following combinations: A; B; C; A and B; A and C; B and C; and A and B and C. Definitions for certain words and phrases are provided throughout this patent document, those of ordinary skill in the art should understand that in many if not most instances, such definitions apply to prior, as well as future uses of such defined words and phrases.

DETAILED DESCRIPTION

The FIGURES described below and the various embodiments used to describe the principles of the present disclosure in this patent document are by way of illustration only and should not be construed in any way to limit the scope of the disclosure. Those skilled in the art will understand that the principles of the present disclosure invention may be implemented in any type of suitably arranged device or system. Additionally, the drawings are not necessarily drawn to scale.

Society is rightfully fearful of germs, dust and other airborne particles. Often one will see another protecting his or her drink with a napkin attempting to prevent such germs, dust and other airborne particles, from penetrating into their drink. While well intended, such napkin designs are often ineffective and unattractive.

Exacerbating the rightful fear of germs, dust and other airborne particles, are Drink Mix-Ups. At a table with multiple clear liquid drinks in the same or similar cups with or without straws, people understandably mistake another drink as his or hers.

Some beverages attract unwanted insects and bugs like bees, flies, gnats, ants and roaches, etc. They crawl, hover over or swarm around beverages and individuals near the drink.

Unfortunately, sinister people intentionally tamper with other people's beverages by dropping foreign substances and harmful pills in them without much of a deterrent.

People like to have conversational pieces, and to have fun and to look at something nice, warm and nostalgic while drinking beverages, either at home, work, restaurants, parties or other gatherings and outings.

It is also too cumbersome and inconvenient to carry around something to cover a drink and straw.

It is estimated that over 500 Million straws are used daily in the United States and that although legislation was recently passed in some states to ban or to reduce the use of plastic straws, materials others than plastic straws i.e. paper, wood, metal and other types of straw materials are on the rise.

According to an embodiment of the disclosure, a cap for straws and/or drinks has been provided. Such disclosure may have one or more of the following advantages depending on the setting:

- Helps protect straws from dust, germs, other airborne particles, bugs, etc.;
- Diminishes the chance of drink mix-ups because straw cap designs, styles, and sizes differ and are/can be personalized;
- Helps reduce being pestered by bugs and insects as the beverage is not as easily detected by them;
- Helps prevent people from tampering with drinks;
- Encourages conversation amongst friends and strangers as to the function of the straw cap and the interests of the user;
- Provides Cheer for straw cap users and onlookers through the fun, interesting and fashionable prints and designs;
- Allows users to easily carry the straw cap with them on a day-to-day basis and while traveling; just like they would their school or state I.D., Driver's License or Credit Card as the straw cap is lightweight, flat and some are hardly larger than a business card;
- Encourages longer use of a plastic straw thereby reducing environmental pollution;
- Ability to recycle the straw caps;
- Permits persons using straws made of other materials like paper, and reusable straw materials like wood and metal, etc., to take comfort in possessing a cleaner straw than an uncovered one.

While the above advantages have been described, it should be understood that certain embodiments of the disclosure may have none of the above described advantages.

FIGS. 1-5 show configurations of straw caps, according to certain embodiments of the disclosure. As shown in FIG. 1, in particular configurations, the straw caps in a non-assembled state, may be flat and have a body 110A, 110B with a triangular shape. While a triangular shape is shown for a non-assembled state in this configuration, one of ordinary skill in the art will recognize that other shapes may also be utilized. The non-assembled flat state allows for ease of packaging, carrying and distribution of the straw caps. Although not shown in FIG. 1, the straw caps may be placed in a package for protection prior to use.

With reference to FIGS. 1 through 5, the configurations of the straw cap are shown as being made of paper; however, the straw cap can be made of a variety of material in different configurations, including, but not limited to, a variety of different types and colors of papers, plastics, and other recyclable materials. In certain configurations, the straw cap may be made of a composite of different materials.

With reference to FIGS. 1 through 4, two examples of particular designs are shown. The particular designs shown herein are meant to be illustrative and not limiting. An additional design is shown with reference to FIG. 5.

Figure 2:
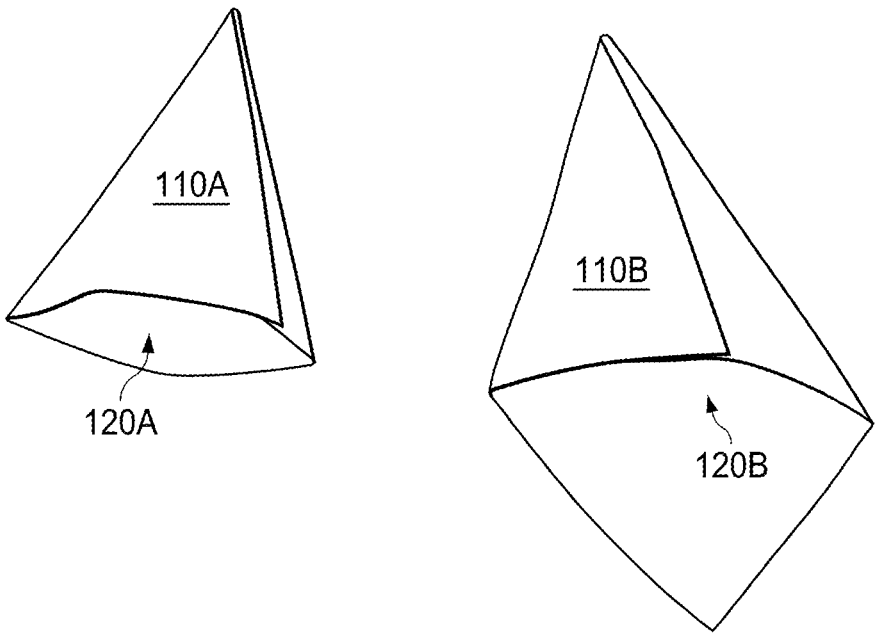
FIG. 2 shows configurations of straw caps in an assembled state, according to embodiments of the disclosure.
Figure 3:
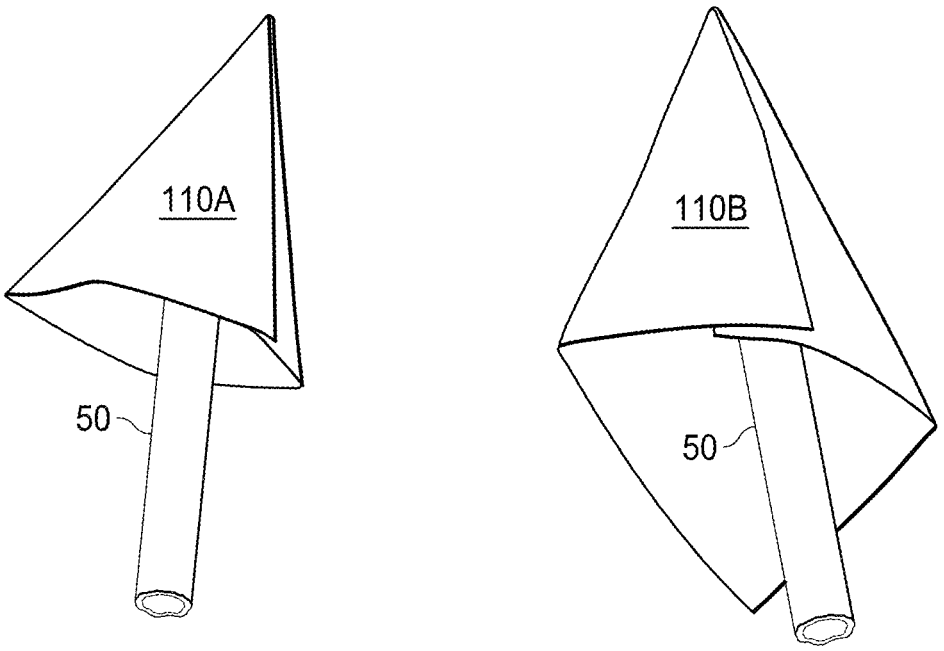
FIG. 3 shows configurations of straw caps in an assembled state on top of a straw, according to embodiments of the disclosure.

The design of the straw cap is intentional and serves several purposes. With reference to FIG. 2, when the straw cap is ready for use, the flat sides of the straw cap are squeezed together so that the triangle opens into a cone-like shape that creates an interior volume 120A, 120B in the respective bodies 110A, 110B—allowing for the straw cap to be placed over the top of a straw 50, for example, as shown in FIG. 3. The pointed cone-shaped volume top allows the straw cap to "tighten" around or to snuggly "embrace" different size straws 50 that are inserted into the narrowing cone-shaped top of the straw cap. In particular configurations, a variety of different shapes and sizes may be utilized to accommodate different shapes, sizes, and configurations of straws 50.

Figure 4:
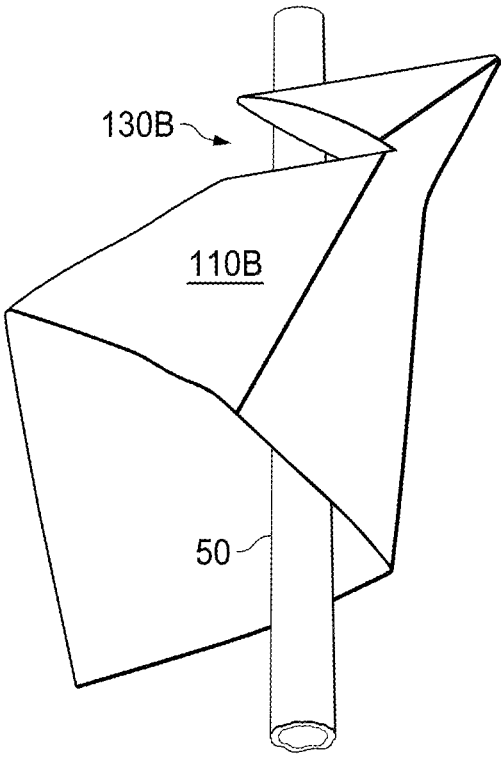
FIG. 4 shows another configuration of a straw cap in an assembled state allowing a straw to pass through a slit, according to embodiments of the disclosure.

With reference to FIG. 4, the triangular shaped body 110B allows for a Sip Slit 130B to be created if the straw cap's material and size permit. The Sip Slit 130B is made towards the top part of the body 110B of the straw cap to allow straw cap users to flip the tip of the straw cap back, push the straw cap down (or to push the straw up through the opening of the Sip Slit 130B) and take a sip of their beverage. After sipping, a user will slide the straw cap back to the top of the straw 50 and place the straw cap tip back over the straw. The Sip Slit 130B is a unique, useful, easy-to-use, protective and fun feature of the straw cap.

Figure 5:
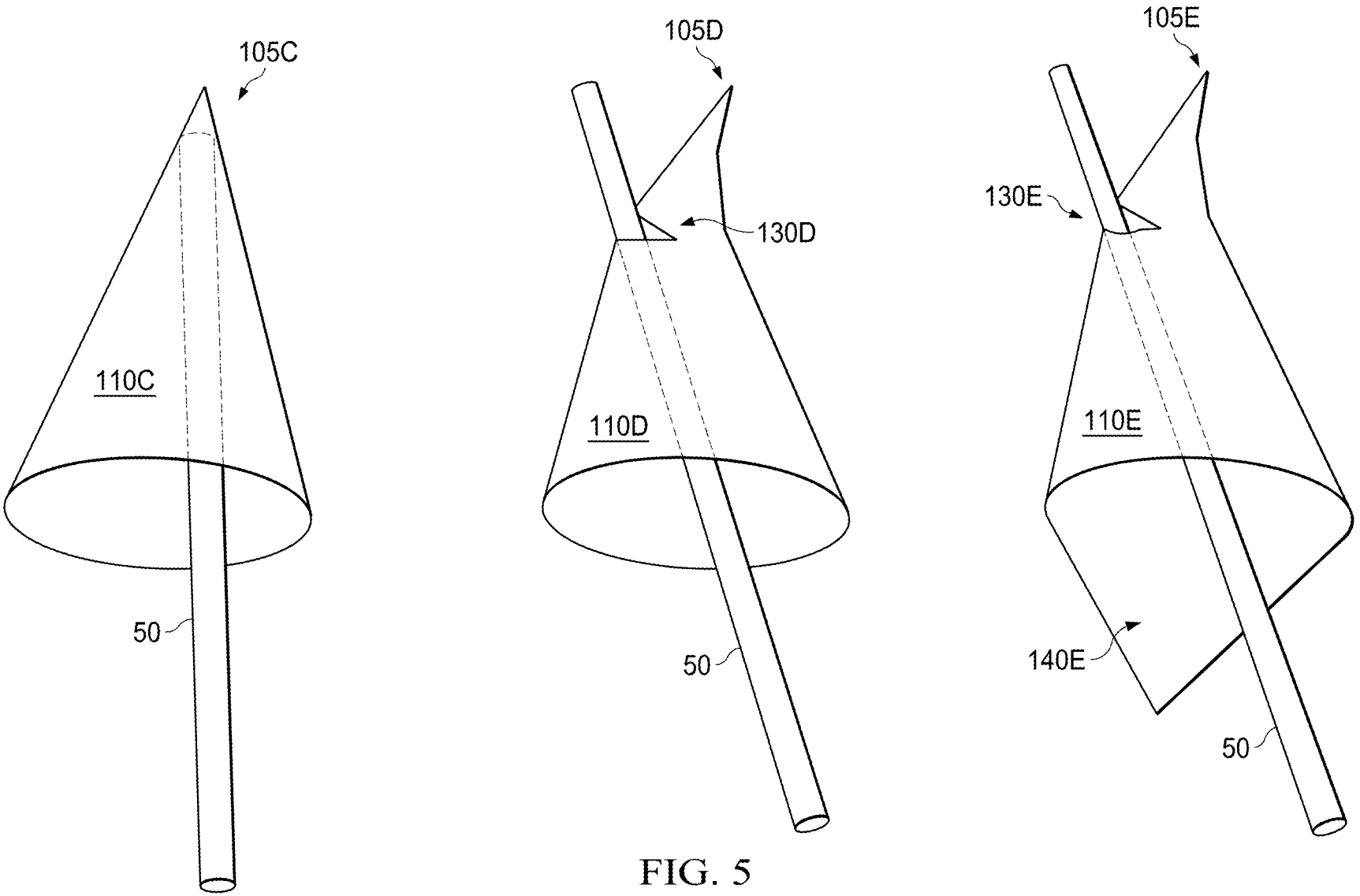
FIG. 5 shows the schematics of additional features of straw caps, according to embodiments of the disclosure.

With reference to FIG. 5, a schematic of certain features of configurations of the straw cap are shown. As shown, a variety of different sizes and configurations may be utilized. Each of bodies 110C, 110D, and 110E include a first feature—a generally cone-shaped portion 105C, 105D, 105E positioned on one side when assembled.

Each of bodies 110D and 110E have a second feature—Sip Slits 130D and 130E, respectively. Body 110E also includes a third feature—a Stabilizer 140E that shields the bottom part of the straw 50 and/or drink thereby preventing entry of foreign items and pests. Also, the Stabilizer 140E further secures the straw cap unto the straw. While a particular configuration of the Stabilizer 140E is shown in FIG. 5, other shapes and configurations may be used in other embodiments. As a non-limiting example, the body has a non-triangular shape in certain configuration; accordingly, the Stabilizer may also have a non-triangular show.

Figure 6:
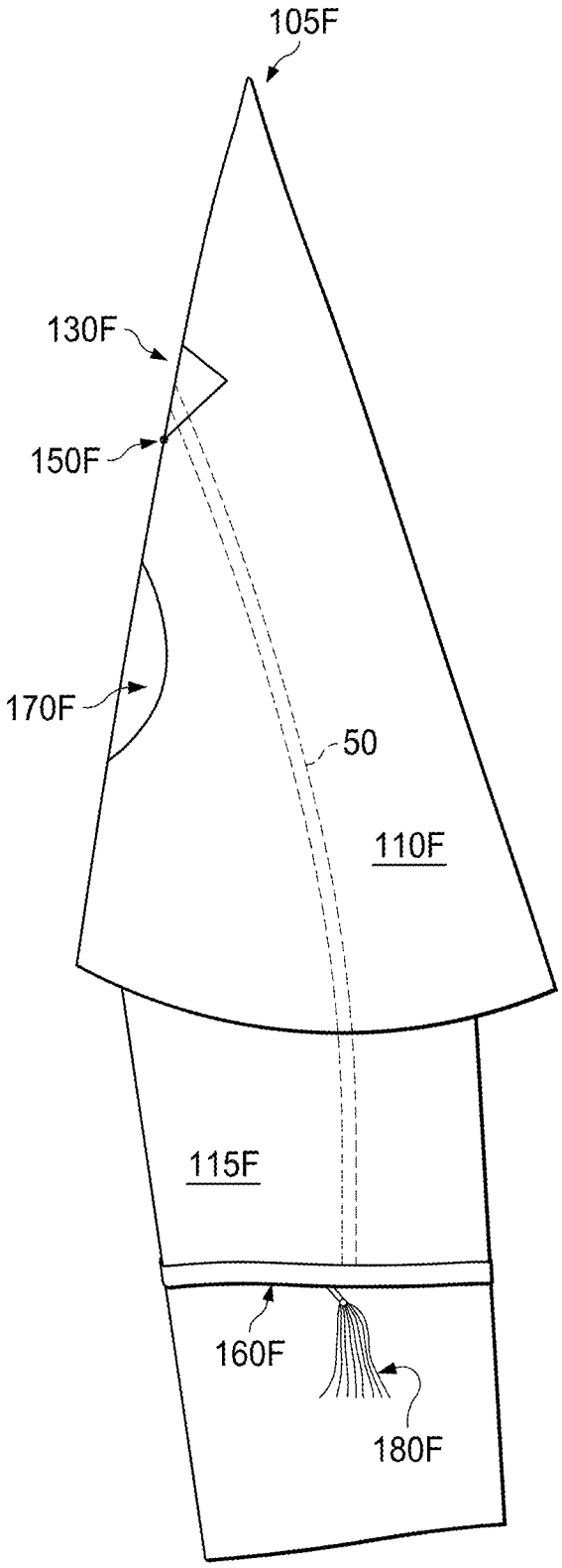
FIG. 6 shows another configuration of a straw cap in an assembled state with a locking mechanism and an extended coverage portion covering the entire beverage container or portions of a cup or glass, according to embodiments of the disclosure.

FIG. 6 shows schematics of additional features of a straw cap, according to another embodiment of the disclosure. Just like the configurations shown with reference to FIGS. 1-5, the straw cap of FIG. 6 may be flat in an unassembled state before being used. Similarly, when assembled, a generally cone-shaped portion 105F is positioned on one side when assembled. And, a Sip Slit 130F is shown. However, the embodiment of FIG. 6 also has other features. As shown in FIG. 6, a locking mechanism 150F may adorn various straw cap models. The locking feature deters others from tampering with another person's drink and is sometimes situated at the Sip Slit 130F. Such a feature is designed to deter such things as Rohypnol ("Ruffles") from being dropped into someone's beverage. The locking mechanism 150F may be made in a variety of different manners that will become apparent to one of ordinary skill in the art after reviewing this mechanism. As a non-limiting example, in one configuration, the locking mechanism may include a clip or clasp that resists movement of the hinged upper portion of the Sip Slit 130F. In particular, a clip or clasp may be positioned on one or both sides of the Sip Slit 130F to engage when the upper portion is locked.

Another feature shown is the extended length and coverage portion 115F of the straw cap. In certain configurations, the straw cap covers the entire straw and cup or glass top and/or the entire beverage container. To allow such a feature, the straw cap includes an elastic band 160F at the bottom that wraps around the base of the beverage container to secure the straw cap until the user removes it. Although described as an elastic band 160F, other items may also be used to engage the container in other configurations. In some configurations, an adhesive, sticky material, or a stretchy or rubber material may be used on at least part of the portion used to engage the container. The extended coverage portion 115F may be made of a variety of materials; and, just like the remainder of the straw cap, may be flat in an unassembled state. In certain configurations, the extended cover 115F may include a flexible material to adjust to differing sizes of containers. In certain configurations, the extended coverage potion may be separate from the body 110F. In other configurations, the body 110F and the extended cover 115F may form a single piece.

With reference to FIG. 6, for added enjoyment, tassels 180F of different shapes, figures, sizes, and colors may be attached to the elastic band 160F. So, not only is the straw cap design unique but the tassels 180F are special too.

With reference to FIG. 6, a branding area 170F is also shown, which may include a person's initials or any type of identifying mark. This branding area 170F may also be used for advertising. The branding area 170F may be as basic as a blank space that allows one to mark his or her name for identification of a drink as his or hers. Alternatively, the branding area 170F may be more advanced and have a logo, banner, or the like to advertise something. Drink names and/or colors may also be used on the advertising portion to distinguish one drink from the next. For example, different drinks may have the same logos, but different background colors to indicate the difference in one another's drinks.

The designs disclosed herein can be used in virtually limitless settings. One may purchase a pack of multiple straw caps and take them anywhere for use everywhere.

Non-limiting examples include drinks at sporting events, drinks at an office, drinks of bus and taxi drivers, drinks on a picnic, drinks at hospitals (for patients with respiratory or compromised immune system challenges), drinks at fast food restaurants, or other dining establishments. Yet other non-limiting examples include places where employee drinks must be kept at central drink stations (e.g., doctors, nurses, and other medical staff).

In certain configurations, the straw cap may be disposable. According to embodiments of the disclosure, the straw cap may either be handed out, for example, by an establishment that serves beverages or by an employer like a hospital which desires to help protect its employees from germs, dust and other airborne particles, tampering, or drink mix-ups. Alternatively, one may bring their own straw cap with them to sanitize their drink handling.

Although described as being a "cap" for a "straw," in certain configurations, the straw itself may be integrated into the design for a specialized straw itself.

In particular configurations, more than one size of a straw cap may be utilized for different size containers and thicknesses of straws. In other configurations, a straw cap may be more universal in scope—capable of handling multiple different containers and thicknesses of straws.

As referenced above, particular configurations of the straw cap may be disposable. Prior to placement on a straw, the straw cap may be unfolded and refolded in a variety of manners. In certain configurations, the straw cap may be sealed and kept in another container for further sanitary treatment, similar to the packaging of an individually wrapped toothpick or wet wipe, and easily be carried in a wallet, coin purse, pocket, etc.

Particular configurations of the embodiment may be commercially sold under the brand name LES STRAW HATS™ straw covers. The following illustrate different configurations of LES STRAW HATS™ straw covers.

As referenced above, the straw caps may be packaged before use. In particular configurations, the packaging of the straw cap is quality and provides additional information about the uniqueness of the product and who may benefit from its use.

In particular configurations, such packaging may offer one or more of the following:

Lays Flat and fits easily in a wallet or coin purse;

The backing behind the Packaging is heavier card stock, to help prevent the Straw Cap from bending or being damaged;

The packaging is able to hold nicely displayed Straw Caps of one or more.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A straw cap comprising:

a body that has portions that are folded on top of one another such that the body is configured to lie flat in a non-assembled state, wherein an unfolding of the portions of the body creates an assembled state with an interior volume that covers a straw top.

2. The straw cap of claim 1, wherein the interior volume has a changing volume configured to embrace different sizes of straws.

3. The straw cap of claim 1, wherein the body has a triangular shape in the non-assembled state and at least a portion of a cone in the assembled state.

4. The straw cap of claim 1, wherein the body extends over a drink top when in the assembled state to prevent entry of foreign items into the drink top.

5. The straw cap of claim 1, wherein the body has a first portion that forms a frustum of a cone when in the assembled state, the frustum of the cone configured to cover the straw top, and the body has a second portion that forms a shield that is configured to extend over at least a portion of a drink top to prevent entry of foreign items into a drink containing a straw corresponding to the straw top.

6. The straw cap of claim 1, wherein the body has a slit configured to allow the top of the straw to pass through the body when the body is in the assembled state, the slit allows a user to take a sip from the top of the straw without removing the body of the straw cap from engaging with the straw.

7. The straw cap of claim 6, wherein the slit creates a hinge-like motion in a top of the body of the straw cap to allow the straw top to pass through the body of the straw cap when the straw cap is in the assembled state.

8. The straw cap of claim 6, further comprising:

a locking mechanism to resist the slit from being opened when the body of the straw cap is in the assembled state.

9. The straw cap of claim 1, further comprising:

a branding area.

10. The straw cap of claim 1, wherein the body can be carried in a wallet when flat in the non-assembled state.

11. The straw cap of claim 1, wherein the body can only engage a straw when in the assembled state and not when in the non-assembled state.

12. The straw cap of claim 1, wherein the interior volume covers both the straw top and at least a portion of a drink when in the assembled state.

13. The straw cap of claim 1, wherein the body is configured to be placed inside a wrapper when flat in the non-assembled state.

14. The straw cap of claim 1, wherein the body has a pointed area at a bottom of the straw cap that bends around towards the interior volume to enclose a top portion of the straw.

15. A straw cap comprising:

a body that is configured to:

lie flat in a non-assembled state such that it may be carried in a wallet, coin purse, or pocket without being damaged, and transform, once ready to use on a straw, to an assembled state to have an interior volume that covers a straw top to prevent entry of foreign items into a drink containing the straw.

16. The straw cap of claim 15, wherein the body has a slit configured to allow the straw top to pass through the body when the body is in the assembled state, the slit allows a user to take a sip from the top of the straw without removing the body of the straw cap from engaging with the straw.

17. The straw cap of claim 16, further comprising:

a locking mechanism to resist the slit from being opened.

18. The straw cap of claim 15, wherein the straw cap is configured to be placed inside a wrapper when flat in the non-assembled state.

19. The straw cap of claim 15, wherein the body has a pointed area at a bottom of the straw cap that bends around towards the interior volume to enclose a top portion of the straw.

* * * * *